US005465848A

United States Patent [19]

Veh et al.

[11] Patent Number: 5,465,848

[45] Date of Patent: Nov. 14, 1995

[54] FLOTATION CELL AND INJECTOR

[75] Inventors: Gerhard Veh, Höchstädt; Peter Schweib, Elchingen; Hans-Dieter Dörflinger, Heidenheim, all of Germany

[73] Assignee: J. M. Voith GmbH, Heidenheim, Germany

[21] Appl. No.: 216,800

[22] Filed: Mar. 23, 1994

[30] Foreign Application Priority Data

Mar. 26, 1993 [DE] Germany ..... 43 09 918.1

[51] Int. Cl.[6] ..... B03D 1/24

[52] U.S. Cl. ..... 209/170; 261/36.1; 261/76; 261/DIG. 75; 210/221.2

[58] Field of Search ..... 209/170; 210/221.1, 210/221.2; 261/36.1, 76, DIG. 75

[56] References Cited

U.S. PATENT DOCUMENTS 4,477,341 10/1984 Schweiss .
4,726,897 2/1988 Schweiss .
4,938,865 7/1990 Jameson .

FOREIGN PATENT DOCUMENTS 277327 8/1988 European Pat. Off. .
3634903 4/1988 Germany .
92/3218 3/1992 WIPO .

*Primary Examiner*—Thomas M. Lithgow
*Attorney, Agent, or Firm*—Marshall, O'Toole, Gerstein, Murray & Borun

[57] ABSTRACT

A flotation cell with at least one injector for introducing a fluid and aspirating air therethrough has a multi-hole aperture plate. Premixing tube sections are disposed in the injector downstream from the aperture plate at a distance from the plate of at least 0.1 times the diameter of a hole in the aperture plate. The tube sections are oriented perpendicular to the aperture plate and open into a mixing tube.

7 Claims, 1 Drawing Sheet

FLOTATION CELL AND INJECTOR

BACKGROUND OF THE INVENTION

1. Field of the Invention

The invention relates to flotation cells and in particular to flotation cells having at least one injector.

2. Description of Related Technology

A flotation cell disclosed in EP 277,327 includes at least one injector for introducing a suspension or solution into the cell. The injector has a multi-hole aperture plate for aspirating air. In such a flotation cell, the aperture plate is located within an inlet tube of the flotation cell through which a suspension flows, namely, at the beginning of a mixing tube section of this inlet line. Downstream of the aperture plate, with respect to the direction of flow of the suspension, air inlet slits are provided in the mixing tube section and are distributed over a periphery thereof. The aperture plate holes typically are located substantially near a periphery of the mixing tube section. However, this is not always a very efficient arrangement.

An attempt has been made to increase the throughput of the aperture plate described in EP 277,327 by utilizing a multiple injector according to DE 36 34 903. Such a mode of operation has also been accompanied by undesirably low efficiency because of the division of the fluid into various injectors—each of which is designed with its own mixing tube.

SUMMARY OF THE INVENTION

It is an object of the invention to overcome one or more of the problems described above. It is also an object of the invention to provide a flotation device with an injector, which operates with very high throughputs, that is, distributes air bubbles into a fluid in large amounts.

According to the invention, a flotation cell is provided having at least one injector for introducing a fluid into the cell and aspirating air into the fluid. The injector includes a multi-hole aperture plate. Tube sections are mounted in the cell downstream of the holes of the aperture plate at a distance therefrom of at least about 0.1 times a diameter of an aperture plate hole. The tube sections are oriented substantially perpendicular to the aperture plate and open into a mixing tube.

Other objects and advantages of the invention will be apparent to those skilled in the art from the following detailed description taken in conjunction with the drawings and the appended claims.

DETAILED DESCRIPTION OF THE INVENTION

A device according to the invention provides very high throughput of a fluid, such as a suspension, through an injector by providing the injector with an aperture plate or nozzle plate having holes that are relatively uniformly distributed over an entire cross-section of the plate. Good distribution of air bubbles in the fluid with a sufficient number of air bubbles is achieved in a plurality of small premixing tube sections that are disposed downstream of the aperture plate with respect to the direction of flow of fluid through the device. The final distribution of air bubbles into the fluid occurs in a connected mixing tube or mixing tube section disposed directly downstream from the small premixing tube sections. The mixing tube section has a diameter that substantially corresponds to the outside diameter of the aperture plate.

A final settling and distribution of the fluid flowing through the device occurs when the fluid flows through a radial diffuser disposed at an outlet end of the mixing tube. Such a diffuser is known from EP 277,327. The radial diffuser provides good distribution of little air bubbles because the fluid flow is essentially horizontal at an outlet region of the device.

Preferably, each hole of the aperture plate cooperates exclusively with an associated premixing tube section in order to result in a desirable air aspiration of the fluid. As a result of the high turbulence in the premixing tube, a large amount of air is sufficiently mixed into the fluid.

Injectors may be designed in which a premixing tube cooperates with several holes of the aperture plate. However, such embodiments result in reduced overall efficiency.

Figure 1:
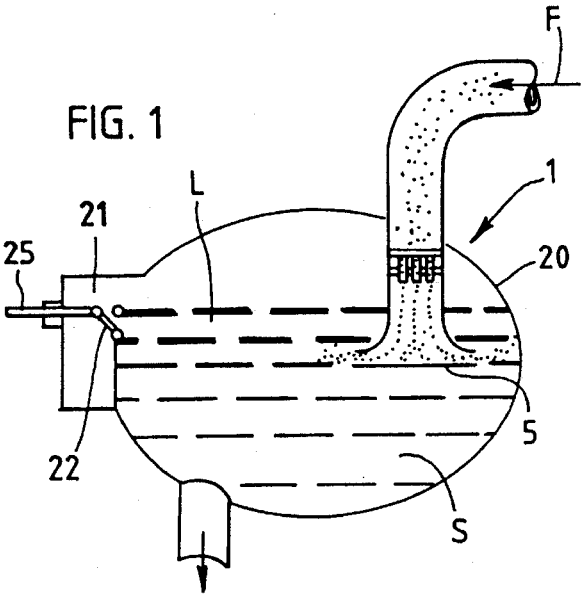
FIG. 1 is a partially schematic sectional view of a flotation cell and injector according to the invention.

With reference to the drawings, a flotation device or cell according to the invention shown in FIG. 1 includes a housing 20 having a substantially oval cross-section and an injector, generally 1, mounted eccentrically in the cell (i.e. mounted near a narrow side of the housing). The device includes a radial diffuser, generally designated 4, having a bottom plate 5 located at an end thereof. The plate 5 is illustratively disposed about 50 cm to about 100 cm below a surface level L of a fluid, illustrated as a suspension S, contained in the housing 20. The surface level L is adjusted with a weir 22, which is adjusted in turn by a cooperating adjusting rod 25, with both the weir 22 and the rod 25 being mounted on the housing 20. Foam which contains impurities and a certain amount of the suspension S flows through an overflow edge of the weir 22 into a foam channel 21.

Figure 2:
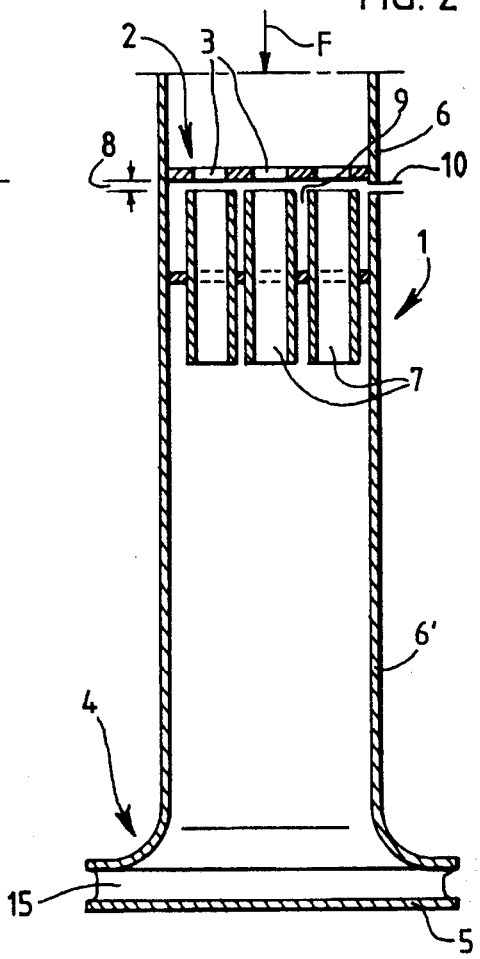
FIG. 2 is an enlarged partially schematic sectional view of the injector of FIG. 1.

Gas, preferably air, is also introduced into the suspension S by the injector 1. With reference to FIG. 2, the introduction of the gas is accomplished by a substantially vertical inlet tube or tube section 6 of the injector having an aperture plate 2 mounted therein. The plate 2 has apertures in the form of round holes 3, distributed uniformly over a periphery of the aperture plate (see FIGS. 3 and 4). In the embodiment of a device according to the invention shown in FIG. 2, a plurality of tube sections 7 of relatively small diameter as compared with the injector, serve as premixing sections. The inside diameter of the small tube sections is preferably at least about 10% larger than the diameter of the holes of the aperture plate. The inside diameter of the aperture plate holes preferably ranges up to (and includes) about 60 mm. Each tube 7 is mounted in the device downstream of (with respect to the direction of fluid flow therethrough indicated by an arrow F), and cooperates with, a particular associated hole 3. A distance designated by the reference numeral 8 between the aperture plate 2 and each tube section 7 is preferably between about 0.15 and about 1.5 times the diameter of the hole 3. The length of each small tube section 7 is preferably about four (4) to about ten (10) times greater than an inside diameter of the tube section 7 or at least about 0.8 times the inside diameter of a mixing tube or tube section 6' disposed directly downstream of the tube sections 7 and connected to or integral with the inlet tube 6. The tube sections 7 each have an open end facing the mixing tube 6'. The diameter of the mixing tube 6' is approximately equal to the outside diameter of the aperture plate 2. Preferably, the injector 1 is contained in a continuous tube (i.e. the injector and the mixing tube sections share the same outside wall). A radial diffuser 4 with a bottom plate 5 is located at an end of the tube 6'. Between the diffuser 4 and the plate 5 there is a gap 15. The width of the gap 15 is equal to between about 7% and about 14% the diameter of mixing tube 6'.

In order to obtain sufficient throughput through the injector 1, an average flow velocity to the aperture plate can be, for example, about 2 m/s, so that, based upon the geometric relationships presented here, a flow velocity of about 12.5 m/s is obtained downstream of the holes of the aperture plate, and a fluid flow of about 4.5 m/s is obtained downstream of the premixing tubes 7. The outflow velocity from the radial diffuser 4 is about 2.2 m/s.

The tube sections 7 act as small injectors, with the air for aspiration being provided in a tube section 9 of an inlet pipe, which is connected to the device downstream of the aperture plate 2. The section 9 includes an air connection 10, shown schematically. A valve (not shown) can be inserted in the air connection to control the amount of aspirated air.

The holes 3 of the aperture plate 2 and the cross-sections of the tube sections 7 do not have to be circular. For example, the holes 3 and/or the premixing tube cross-sections may be in the form of a relatively uniform polygon or an ellipse.

Figure 3:
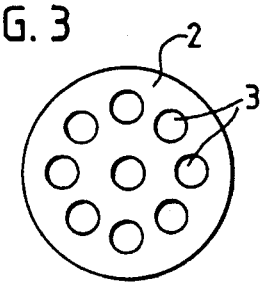
FIG. 3 is a top plan view of the injector of FIG. 1.

FIG. 3 shows a configuration of holes 3 in the plate 2 wherein the holes 3 are distributed uniformly in a circular pattern thereon and include a hole disposed at a center of the plate 2.

Figure 4:
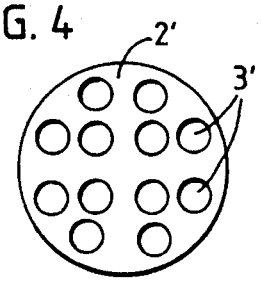
FIG. 4 is a top plan view of a second embodiment of an injector according to the invention.

FIG. 4 illustrates an embodiment of an aperture plate 2' according to the invention having a somewhat uniform arrangement of holes 3', different from the arrangement of holes 3 of the plate 2 shown in FIG. 3.

The number of holes in the aperture plate 2 or 2' may be limited to 16 because a larger number of holes usually does not provide an increased efficiency.

Figure 5:
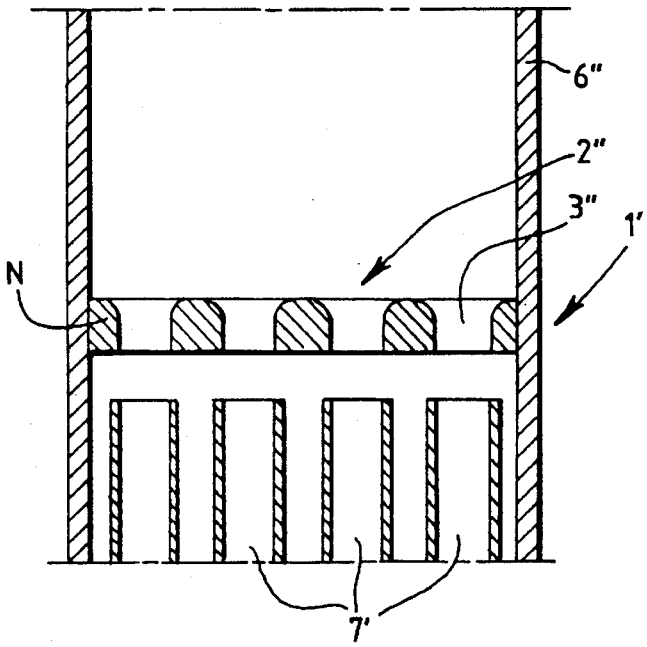
FIG. 5 is a partially schematic sectional view of a third embodiment of a flotation cell and injector according to the invention.

FIG. 5 shows a second embodiment of a portion of a device according to the invention. The elements designated by the reference numerals 1', 2", 3", 6", and 7' are similar in function to the elements designated by the reference numerals 1, 2, 3, 6, and 7 described herein with respect to FIGS. 1 and 2. The injector 1' differs from the injector 1 in that it is equipped with a nozzle plate 2' having nozzles N which define the holes 3'.

The foregoing detailed description is given for clearness of understanding only, and no unnecessary limitations should be understood therefrom, as modifications within the scope of the invention will be apparent to those skilled in the art.

We claim:

1. In a flotation cell comprising at least one injector for introducing a fluid into the cell and aspirating air into the fluid, the injector having a conduit with an air inlet and a substantially planar multi-hole aperture plate disposed in the conduit, the improvement comprising:

a plurality of tube sections disposed in the conduit, each tube having an upstream end located downstream of the aperture plate with respect to the direction of fluid flow therethrough and at a distance from the plate equal to at least about 0.1 times a diameter of a hole of the plate, the tube sections each defining an axis disposed substantially perpendicular to the aperture plate and each tube having a downstream end opening into a mixing tube.

2. The improvement of claim 1 wherein the aperture plate is a nozzle plate and each hole therein is defined by a nozzle.

3. The improvement of claim 1 wherein each hole of the aperture plate is aligned with a corresponding tube section.

4. The improvement of claim 3 wherein each tube section has an inside diameter of at least about 1.05 times the diameter of the corresponding aligned hole, both the tube sections and the holes having a circular shape.

5. The improvement of claim 1 wherein an air aspiration tube section is disposed in the injector downstream of the aperture plate, the air aspiration section having substantially the same outer wall as that of the mixing tube section, at least in the vicinity of the tube sections.

6. The improvement of claim 1 wherein the holes of the aperture plate are distributed uniformly in a circular pattern thereon.

7. The improvement of claim 6 wherein the aperture plate includes an additional central hole.

* * * * *